US005534184A

United States Patent [19]

Underwood

[11] Patent Number: 5,534,184

[45] Date of Patent: Jul. 9, 1996

[54] CONCENTRATED LIQUID HARD SURFACE DETERGENT COMPOSITIONS CONTAINING MALEIC ACID-OLEFIN COPOLYMERS

[75] Inventor: David C. Underwood, Cincinnati, Ohio

[73] Assignee: The Procter & Gamble Company, Cincinnati, Ohio

[21] Appl. No.: 326,156

[22] Filed: Oct. 19, 1994

Related U.S. Application Data

[63] Continuation of Ser. No. 81,742, Jun. 23, 1993, abandoned.

[51] Int. Cl.[6] ..... C11D 3/37; C11D 1/75; C11D 1/90; C11D 1/92

[52] U.S. Cl. ..... 510/426; 510/433; 510/434; 510/476; 510/499; 510/427; 510/419; 510/432

[58] Field of Search ..... 252/DIG. 10, DIG. 14, 252/DIG. 2, 174.24, 545, 546, 547, 548, 558, 559, 539, 540, 156

[56] References Cited

U.S. PATENT DOCUMENTS

| | | | |
|---|---|---|---|
| 3,939,090 | 2/1976 | Zmoda | 252/90 |
| 4,017,541 | 4/1977 | Stubbs et al. | 260/535 |
| 4,175,062 | 11/1979 | Disch et al. | 252/540 |
| 4,343,725 | 8/1982 | Kiewert et al. | 252/542 |
| 4,448,704 | 5/1984 | Barby et al. | 252/91 |
| 4,557,853 | 12/1985 | Collins | 252/128 |
| 4,559,159 | 12/1985 | Denzinger et al. | 252/174.24 |
| 4,559,162 | 12/1985 | Abel et al. | 252/321 |
| 4,606,842 | 8/1986 | Keyes et al. | 252/174.23 |
| 4,673,523 | 6/1987 | Smith et al. | 252/91 |
| 4,690,779 | 9/1987 | Baker et al. | 252/546 |
| 4,725,655 | 2/1988 | Denzinger et al. | 526/65 |
| 4,891,160 | 1/1990 | Vander Meer | 252/545 |
| 5,009,805 | 4/1991 | Perner et al. | 252/174.24 |
| 5,055,540 | 10/1991 | Hughes et al. | 526/318.2 |
| 5,108,660 | 4/1992 | Michael | 252/545 |
| 5,126,068 | 6/1992 | Burke et al. | 252/174.21 |
| 5,126,069 | 6/1992 | Kud et al. | 252/174.23 |
| 5,232,632 | 8/1993 | Woo et al. | 252/546 |
| 5,336,445 | 8/1994 | Michael et al. | 252/548 |
| 5,342,549 | 8/1994 | Michael | 252/546 |
| 5,350,541 | 9/1994 | Michael et al. | 252/549 |
| 5,362,422 | 11/1994 | Masters | 252/544 |
| 5,376,298 | 12/1994 | Michael | 252/153 |
| 5,382,376 | 1/1995 | Michael et al. | 252/153 |

OTHER PUBLICATIONS

BASF Corporation, Technical Brochure, Improvements in Glass Cleaner Technology, 1992 (Sokalan® polymers in alkaline glass cleaners) (no mo. available).

*Primary Examiner*—Paul Lieberman
*Assistant Examiner*—A. Hertzog
*Attorney, Agent, or Firm*—W. J. Winter; B. J. Corstanje; R. A. Dabek

[57] ABSTRACT

Disclosed are concentrated alkaline liquid detergent compositions suitable for dilution with hard or de-ionized water. The compositions can be stored before and after dilution for prolonged periods at temperatures ranging from about 40° F. (4° C.) to about 100° F. (38° C.) without precipitates forming. The compositions contain a maleic acid-olefin copolymer, a detergent surfactant, a solvent/buffer system comprising beta-aminoalkanol and/or monoethanolamine, and less than about 85% water. The copolymer acts as a crystallization inhibitor and is uniquely soluble in the concentrated liquid detergent compositions.

13 Claims, No Drawings

CONCENTRATED LIQUID HARD SURFACE DETERGENT COMPOSITIONS CONTAINING MALEIC ACID-OLEFIN COPOLYMERS

This is a continuation of application Ser. No. 08/081,742, filed on Jun. 23, 1993, now abandoned.

FIELD OF THE INVENTION

This invention relates to concentrated liquid detergent compositions for use in cleaning hard surfaces. Such compositions can be diluted with tap water and stored in a ready-to-use form for extended periods without solids forming.

BACKGROUND OF THE INVENTION

Concentrated liquid hard surface cleaners which are suitable for dilution with tap water have advantages over ready-to-use hard surface cleaners. Dilutable concentrates are typically less expensive to manufacture and ship, require less storage space prior to dilution and impose a lower burden on landfill operations since less packaging is involved.

Development of such dilutable liquid concentrates presents unique problems. First, they should contain a sequestering agent or crystallization inhibitor that will help prevent precipitation of insoluble salts of polyvalent metal cations present in hard water diluents. At the typically basic pH of concentrated hard surface cleaners, the polyvalent metal cations react with carbonates and other anionic species in the tap water and precipitate. Sequestering agents, however, tend to promote spotting/filming on the surfaces being cleaned. Accordingly, it has been difficult to formulate a dilutable concentrated liquid hard surface cleaner that contains sufficient sequestering agents but does not promote excessive spotting/filming.

Second, the sequestering agent should be soluble in both the liquid concentrate and aqueous dilutions thereof over a wide range of concentrations. Sequestering agents typically require carboxylate or phosphate groups to interact with hardness ions and are soluble in dilute aqueous solutions because of the interactions between water and the highly-charged sequestering moieties in these molecules. However, concentrated dilutable cleaning solutions that contain high levels of non-aqueous cleaning solvents pose a problem in getting adequate solubility of the sequestering agents. Sequestrants are typically much less soluble because they do not effectively interact with the solvents to maintain solubility. For example, polycarboxylate sequestrants that are soluble in water are typically not very soluble in non-aqueous solvents because of the relatively high charge density in these polycarboxylate sequestrants compared to the non-aqueous cleaning solvents. This limits the amount of sequestrant that can be added to a concentrated hard surface cleaning composition. In regions where the water is very hard, this raises the real risk that there will be insufficient sequestrant to prevent precipitation of hardness ions in the diluted cleaner, with the result that precipitated salts will form in the diluted cleaning solution, and plug the sprayer used to deliver the cleaning solution to the surface to be cleaned.

Given the forgoing, there is a continuing need to provide dilutable concentrates for use as hard surface cleaners that will remain stable for prolonged periods when diluted with hard or de-ionized water and which will not promote spotting/filming. It is therefore an object of this invention to provide such a product by utilizing a maleic acid-olefin copolymer as a crystallization inhibitor in a concentrated liquid detergent composition.

SUMMARY OF THE INVENTION

The present invention relates to dilutable concentrated liquid detergent compositions comprising: (a) maleic acid-olefin copolymers; (b) detergent surfactant; (c) solvent/buffer system comprising a beta-aminoalkanol and/or monoethanolamine containing from about three to about six carbon atoms; and (d) a pH of from about 9 to about 13, and (e) less than about 85% water. These compositions can be stored before and after dilution with hard or de-ionized water for prolonged periods without precipitates forming.

All ratios and percentages herein are based on weight unless otherwise specified.

DETAILED DESCRIPTION OF THE INVENTION

The concentrated liquid detergent compositions of the present invention comprise a maleic acid-olefin copolymer and less than about 85% water. These compositions can be used in diluted or undiluted form to clean hard surfaces. The diluted form is especially useful in providing streak-free cleaning of glass and other shiny surfaces.

Liquid hard surface cleaners typically contain the following materials at the levels indicated (as weight percents).

| | water | non-aqueous solvent | surfactant | buffer | sequestrant |
|---|---|---|---|---|---|
| ready-to-use | 96–85 | 3–15 | 0.05–0.4 | 0.1–0.2 | 0.02–0.10 |
| 5x concentrate | 85–25 | 15–75 | 0.25–2.0 | 0.5–1.0 | 0.1–0.5 |
| 10x concentrate | 65–20 | 35–80 | 0.5–4.0 | 1.0–1.5 | 0.2–1.0 |

The ready-to-use formula is a single strength product. The 5× and 10× concentrates can be diluted with up to 4 and 9 equal volumes of water, respectively, to make the ready-to-use product. Liquid concentrates as low as about 2× can be made using the formulations herein.

A. Sequestrants

In view of the low water content of the concentrated liquid detergent compositions herein, it is surprising that the maleic acid-olefin copolymers are soluble. Most sequestrants are not sufficiently soluble in the concentrated solvent compositions that would typically be used to formulate dilutable cleaning solutions. An important aspect of this invention is the discovery that these maleic acid-olefin copolymers are soluble in this system, can act as sequestrants in the diluted product and do not streak or form solids on hard surfaces.

A solvent mixture consisting of 40% 2-propanol, 20% butoxypropanol and 40% water was prepared. This mixture exemplified the typical solvent formula found in concentrated liquid hard surface cleaners that have good grease-cutting abilities. Dilution of the mixture with 9 parts of hard tap water (e.g., greater than about 5 grain) provided a ready-to-use composition with good grease-cutting characteristics. The diluted composition comprised 4% 2-propanol and 2% butoxypropanol. It is known that complete prevention of hardness precipitation from all water types requires about 0.1% of sequestrant in the diluted product. For a concentrate that is designed to be diluted with 9 parts of water, this would require about 1% of sequestrant in the concentrated composition. Therefore, a number of different types of sequestrants were screened at room temperature to determine if any of them were soluble enough in the solvent mixture to provide the requisite sequestering benefit. The solubility limits were determined by noting the point at which turbidity or a second phase was visible in the mixture. To accurately represent the conditions found in alkaline cleaning solutions, the pH of the mixture was adjusted to between about 11 and about 12 during addition of the sequestrants.

| Sequestrant Type | Solubility, Weight % (as active) | Trade name/ Identification |
|---|---|---|
| acrylate/maleate copolymer | 0.06 | Sokalan CP5 |
| polyacrylate copolymer | 0.04 | Acumer 9000 |
| acrylate/sulfonate/nonionic polymer | 0.37 | Acumer 3 100 |
| acrylate/maleate copolymer | 0.10 | Acusol 480N |
| acrylate/sulfonate copolymer | 0.13 | Acumer 2100 |
| polyacrylate copolymer | 0.04 | Acusol 840 |
| maleate/olefin copolymer | greater than 2.7 | Sokalan CP9 |
| polycarboxylate monomer | 0.6 | citric acid |
| carboxylate/amine monomer | 0.8 | Tetrasodium EDTA |

Sokalan CP5 and CP9 are trademarks of BASF Corporation. Acusol and Acumer are trademarks of Rohm & Haas Company. EDTA is ethylene diamine tetraacetic acid.

Surprisingly, only the maleate/olefin copolymer was sufficiently soluble at a level higher than 1% in the solvent mixture, and therefor is the only candidate to provide excellent sequestering benefits in very concentrated cleaning compositions when diluted with hard water. While citric acid and tetrasodium EDTA are somewhat soluble, they cause spotting/filming on hard surfaces. Acumer 3100 also works to some extent, but it also forms streaks or films on hard surfaces.

While not intended to be bound by theory, it is believed that maleic acid-olefin copolymers may be uniquely suited for sequestration and solubility in organic solvents because of their structure. The carboxylate groups provide sequestering ability, while the hydrocarbon groups adjacent or near the carboxylate groups provide steric hindrance to prevent the polymer from curling up on itself in non-aqueous solutions, and also, provide a beneficial degree of solubility in non-aqueous solvents.

These copolymer-containing concentrates can be stored for extended periods before and after dilution with hard or de-ionized water. Most dilutable concentrates for use as hard surface cleaners are diluted just prior to the point of use and are not stored for extended periods. During extended storage periods, calcium and magnesium salts form insoluble species with carbonates and other anionic species found in hard water (e.g., at least about 5 grain) in the alkaline environment of the cleaner. The copolymer-containing concentrates of the present invention, however, can be diluted with hard water to form a ready-to-use product, which remains precipitate-free for up to about 12 months at temperatures ranging from about 40° F. (4° C.) to about 100° F. (38° C.).

Maleic Acid-Olefin Copolymer

The concentrated liquid detergent compositions herein comprise maleic acid-olefin copolymers having the formula

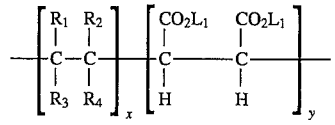

wherein $L_1$ is selected frown the group of hydrogen, ammonium or an alkali metal; and $R_1$, $R_2$, $R_3$ and $R_4$ are each independently selected from the group of hydrogen or an alkyl group (straight or branched, saturated or unsaturated) containing from 1 to about 8 carbon atoms, preferably from 1 to about 5 carbon atoms. The monomer ratio of x to y is from about 1:5 to about 5:1, preferably from about 1:3 to about 3:1, and most preferably from 1.5:1 to about 1:1.5. The average molecular weight of the copolymer will typically be less than about 20,000, more typically between about 4,000 and about 12,000. The level of maleic acid-olefin copolymer present in the concentrated composition is from about 0.05% to about 1.0%, preferably from about 0.1% to about 0.9%. The level of the copolymer present in the diluted composition is from about 0.02% to about 0.10%, preferably from about 0.04% to about 0.08%. These copolymers can be provided by known and conventional means. Such copolymers are described in U.S. Pat. No. 5,126,068, the description and preparation of which is incorporated herein by reference.

A preferred maleic acid-olefin copolymer for use in the liquid concentrate is a maleic acid-di-isobutylene copolymer having an average molecular weight of about 12,000 and a monomer ratio (x to y) of about 1:1. Such a copolymer is available from the BASF Corporation under the trade name "Sokalan CP-9." [$L_1$ is hydrogen or sodium, $R_1$ and $R_3$ are hydrogen, $R_2$ is methyl, and $R_4$ is neopentyl.] Another preferred product is a maleic acid-trimethyl isobutylene ethylene copolymer [$L_1$ is hydrogen or sodium, $R_3$ and $R_1$ are each methyl, $R_2$ is hydrogen and $R_4$ is tertiary butyl].

B. Detergent Surfactant

The concentrated liquid detergent compositions comprise a detergent surfactant. The surfactant is present at levels of from about 0.05% to about 10%, more preferably from about 0.25% to about 3%, most preferably from about 0.5% to about 3%.

Surfactants suitable for use in the liquid concentrate include well-known synthetic anionic, nonionic, and zwitterionic surfactants. The limitation on the surfactant is that it must be soluble in the solvent/buffer system described hereinafter at temperatures ranging from about 40° F. (4° C.) to about 100° F. (38° C.). At these temperatures, the selected surfactant must also not form a crystalline solid with the other ingredients. For example alkyl sulfate is crystalline at room temperature but when used in the compositions herein it does not crystallize. Such suitable detergent surfactants can include the alkyl- and alkylethoxylate- (polyethoxylate) sulfates, paraffin sulfonates, olefin sulfonates, alkoxylated (especially ethoxylated) alcohols and alkyl phenols, alpha-sulfonates of fatty acids and of fatty acid esters, and the like, which are well-known from the detergency art. In general, the detergent surfactants contain an alkyl group in the $C_9$–$C_{18}$ range. The anionics can be used in the form of their sodium, potassium, ammonium or alkanolammonium salts. The nonionics often contain from about 5 to about 17 ethylene oxide groups. The zwitterionics generally contain both a quaternary ammonium group and an anionic group selected from sulfonate and carboxylate groups. Some specific surfactants suitable for use herein are described in the broad surfactant disclosure of U.S. Pat. No. 4,287,080 to Siklosi, issued Sep. 1, 1982, which disclosure is incorporated herein by reference in its entirety.

Another detailed listing of suitable surfactants, can be found in U.S. Pat. No. 4,557,853, to Collins, issued Dec. 10, 1985, which disclosure is incorporated herein by reference. Commercial sources of such surfactants can be found in McCutcheon's *Emulsifiers and Detergents,* North American Edition, 1992, McCutcheon Division, MC Publishing Company, which is also incorporated herein by reference.

Other suitable surfactants include one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; fluorocarbon surfactants such as potassium fluorinated alkylcarboxylates and fluorinated alkyl polyoxyethylene ethanols; and amides having the formula:

$$R_5-\overset{\overset{\displaystyle O}{\|}}{C}-N(R_6)_2$$

wherein $R_5$ is a straight or branched chain alkyl group containing from about 7 to about 15 carbon atoms and having an average carbon chain length of from about 9 to about 13 carbon atoms and wherein each $R_6$ is a hydroxy alkyl group containing from 1 to about 3 carbon atoms. It is understood that mixtures of various surfactants can be used.

A preferred zwitterionic detergent surfactant for use in the liquid concentrate is a hydrocarbyl-amidoalkylenesulfobetaine having the formula:

$$R_7-\underset{\underset{\displaystyle O}{\|}}{C}-\overset{\overset{\displaystyle R_8}{|}}{N}-\left(\overset{\overset{\displaystyle R_9}{|}}{C}\right)_n-\overset{\overset{\displaystyle R_8}{|}}{N^+}-\left(\overset{\overset{\displaystyle R_9}{|}}{C}\right)_n-SO_3^-$$

wherein each $R_7$ is an alkyl group containing from about 8 to about 20, preferably from about 10 to about 18, more preferably from about 12 to about 16 carbon atoms, each $R_8$ is either hydrogen or a short chain alkyl or substituted alkyl containing from 1 to about 4 carbon atoms, preferably groups selected from the group of methyl, ethyl, propyl, hydroxy substituted ethyl or propyl and mixtures thereof, preferably methyl, each $R_9$ is selected from the group of hydrogen and hydroxy groups, and each "n" is a number from 1 to about 4, preferably from 2 to about 3, more preferably about 3, with no more than about one hydroxy group in any $C(R_9)_2$ moiety. The $R_7$ groups can be branched and/or unsaturated, and such structures can provide spotting/filming benefits, even when used as part of a mixture with straight chain alkyl $R_7$ groups. The $R_8$ groups can also be connected to form ring structures. These surfactants provide superior grease and soil removal and/or filming/streaking and/or "anti-fogging" and/or perfume solubilization properties.

The diluted compositions comprising hydrocarbyl-amidoalkylene sulfobetaine are especially suited for cleaning shiny surfaces such as glass. It is an advantage of this surfactant that concentrated compositions containing it can be more readily diluted by consumers since it does not interact with hardness cations as readily as conventional anionic detergent surfactants. It is also extremely effective at very low levels, e.g., below about 1%.

Preferred hydrocarbyl-amidoalkylenesulfobetaine detergent surfactants include the $C_{10}$–$C_{14}$ fatty acyl-amidopropylene (hydroxypropylene) sulfobetaines, e.g. the detergent surfactant available from the Sherex Company under the tradename "Varion CAS Sulfobetaine". Also preferred is cocoamidopropylbetaine, e.g., the detergent surfactant available from the Sherex Company under the Tradename "Varion CADG Betaine".

A preferred anionic surfactant for use in the liquid concentrate has the following formula

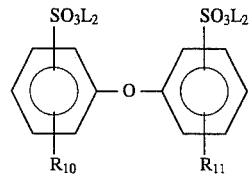

wherein $R_{10}$ and $R_{11}$ are each independently an alkyl group comprising from about 8 to about 16 carbon atoms, and $L_2$ is selected from the group of hydrogen, sodium, ammonium, magnesium and lithium. Specific ring positions for the $R_{10}$, $R_{11}$ and $SO_3L_2$ moieties are not critical. These anionics help solubilize extra cleaning solvent (e.g., butoxypropanol) perfume without needing more non-cleaning solvents (e.g., isopropanol) and without promoting filming/streaking. These anionic surfactants can be used alone or as cosurfactants combined with zwitterionic detergent surfactants. Examples of these anionic detergent surfactants are Dowfax 3B2 (Dow Chemical Company of Midland, Mich.) and Polytergent 3B2 (Olin Chemicals of Stamford, Conn.).

A preferred nonionic surfactant for use in the liquid concentrate are the amine oxide detergent surfactants. These surfactants preferably have the formula $$R_{14}-\overset{\overset{\displaystyle R_{15}}{|}}{\underset{\underset{\displaystyle R_{16}}{|}}{N}}\longrightarrow O$$

wherein $R_{14}$ is an alkyl group containing from about 10 to about 28 carbon atoms, preferably from about 10 to about 16 carbon atoms; and $R_{15}$ and $R_{16}$ are each independently selected from the group of alkyl and hydroxyalkyl radicals containing from 1 to about 3 carbon atoms. Other suitable amine oxides for use herein are described in U.S. Pat. No. 4,470,923 to Koster, issued Sep. 11, 1984, which is incorporated herein by reference.

The detergent surfactant can also comprise a short-chain ($C_8$–$C_{10}$) amphocarboxylate. Amphocarboxylates are well-known from the detergency art. These surfactants are amino derivatives of carboxylic acids. The amino group can be primary, secondary, tertiary or quaternary. These amphocarboxylates can be used alone, or preferably as cosurfactants with a sulfobetaine in a ratio of amphocarboxylate to sulfobetaine of from about 1:3 to about 3:1, preferably from about 1:1.5 to about 1.5:1 Amphocarboxylates, especially amphocarboxylates in combination with sulfobetaines, provide improved filming/streaking benefits. An example of a suitable amphocarboxylate for use herein is "Rewoteric AMV" (Sherex Company).

C. Buffer System

The buffer system within the liquid concentrate is formulated to provide an alkaline environment for both the liquid concentrate and aqueous dilutions thereof. The alkaline environment provides grease cleaning properties.

Specifically, the buffer system is formulated to give the liquid concentrate and aqueous dilutions thereof a pH of from about 9 to about 13, preferably from about 9.7 to about 12, more preferably from about 9.7 to about 11.5. The buffering system comprises monoethanolamine and/or beta-aminoalkanol and, optionally, but preferably, cobuffer and/or alkaline material selected from the group of ammonia, other $C_2$–$C_4$ alkanolamines, alkali metal hydroxides, silicates, borates, carbonates, bicarbonates, and mixtures thereof. The preferred cobuffering/alkalinity materials are alkali metal hydroxides. The level of the optional cobuffer/alkalinity source in the liquid concentrate is from 0% to about 5%.

As described hereinafter, the monoethanolamine and/or beta-aminoalkanols in the buffer system can also act as solvents within the liquid concentrate.

D. Solvent System

The solvent system in the liquid concentrate comprises monoethanolamine and/or the beta-aminoalkanols. The solvent system can further comprise other non-aqueous solvents.

The liquid concentrates also contain less than about 85% water, preferably less than about 60% water, more preferably from about 45% to about 55% water. Accordingly, the liquid concentrates will typically contain from about 15% to about 72% non-aqueous solvent, more typically from about 40% to about 65% non-aqueous solvent. These concentrated compositions (e.g., low water content) provide cost savings from a manufacturing, shipping product storage and packaging perspective.

Monoethanolamine and/or Beta-aminoalkanols

As components of the solvent system, the monoethanolamine and/or beta-aminoalkanols provide improved spotting/filming characteristics to the cleaning compositions herein.

These compounds serve primarily as solvents when the pH of the concentrate is above about 11.0, and especially above 11.7. The monoethanolamine and/or beta-aminoalkanol compounds are present within the liquid concentrate at levels of from about 0.05% to about 10%, preferably from about 1% to about 5%. These compounds are present within the diluted composition at levels of from about 0.05% to about 2%.

A preferred beta-aminoalkanol for use herein has the formula

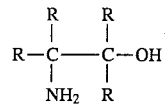

wherein each R is selected from the group of hydrogen and alkyl groups containing from one to four carbon atoms and the total of carbon atoms in the compounds is from three to six, preferably four. Preferably, beta-aminoalkanols have a primary hydroxyl group, i.e. the R on the carbon with the hydroxyl group are both hydrogen. The amine group is preferably not attached to a primary carbon atom, i.e., the R is an alkyl group and not hydrogen. More preferably the amine group is attached to a tertiary carbon atom to minimize the reactivity of the amine group. Preferred beta-aminoalkanols are 2-amino-1-butanol; 2-amino-2-methylpropanol; and mixtures thereof. The most preferred beta-aminoalkanol is 2-amino-2-methylpropanol since it has the lowest molecular weight of any beta-aminoalkanol having the amine group attached to a tertiary carbon atom.

The beta-aminoalkanols do not adversely affect spotting/filming of hard surfaces. This is especially important for cleaning of shiny surfaces such as glass. In addition, the beta-aminoalkanols provide superior cleaning of hard-to-remove greasy soils and superior product stability, especially under high temperature conditions. The beta-aminoalkanols, and especially the preferred 2-amino, 2-methylpropanol, are surprisingly volatile from cleaned surfaces considering their relatively high molecular weights.

Other Non-aqueous Solvents

The solvent system can also further comprise other non-aqueous solvents, preferably non-aqueous polar solvents, that have cleaning activity in addition to that provided by the monethanolamine and/or beta-aminoalkanols. These other solvents can be any of the well-known "degreasing" solvents commonly used in, for example, the dry cleaning industry, in the hard surface cleaner industry and the metalworking industry. The liquid concentrates can comprise up to about 50%, more typically from about 10% to about 30% of these other non-aqueous solvents.

A useful definition of these other non-aqueous solvents can be derived from the solubility parameters as set forth in "The Hoy," a publication of Union Carbide, incorporated herein by reference. The most useful parameter appears to be the hydrogen bonding parameter which is calculated by the formula $$\gamma H = \gamma T \left[ \frac{\alpha - 1}{\alpha} \right]^{1/2}$$

wherein $\gamma H$ is the hydrogen bonding parameter, $\alpha$ is the aggregation number, $$(\text{Log } \alpha = 3.39066\ T_b/T_c - 0.15848 - \text{Log } M/d), \text{ and}$$

$\gamma T$ is the solubility parameter which is obtained from the formula $$\gamma T = \left[ \frac{(\Delta H_{25} - RT)d}{M} \right]^{1/2}$$

where $\Delta H_{25}$ is the heat of vaporization at 25° C. (77° F.), R is the gas constant (1.987 cal/mole/deg., T is the absolute temperature in °K., $T_b$ is the boiling point in °K., $T_c$ is the critical temperature in °K., d is the density in grams/ml, and M is the molecular weight.

For the liquid concentrate herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Many of these non-aqueous solvents comprise hydrocarbon or halogenated hydrocarbon moieties of the alkyl or cycloalkyl type, and have a boiling point well above room temperature, i.e., above about 20° C. (68° F.).

The formulator of the liquid concentrate will be guided in the selection of the optional solvent partly by the need to provide good grease-cutting properties, and partly by aesthetic considerations. For example, kerosene hydrocarbons function quite well for grease cutting but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_{14}$ alkyl aromatic solvents, especially the $C_6$–$C_9$ alkyl benzenes, preferably octyl benzene, exhibit excellent grease: removal properties and have a mild, pleasant odor. Likewise, the olefin solvents having a boiling point of at least about 100° C. (212° F.), especially alpha-olefins, preferably 1-decene or 1-dodecene, are excellent grease removal solvents.

Generically, the glycol ethers useful herein have the formula $R_{17}O(R_{18}O)_mH$ wherein each $R_{17}$ is an alkyl group which contains from about 3 to about 8 carbon atoms, each $R_{18}$ is either ethylene or propylene, and m is a number from 1 to about 3. The most preferred glycol ethers are selected from the group of monopropyleneglycol monopropyl ether, dipropyleneglycol monobutyl ether, monopropyleneglycol monobutyl ether, diethyleneglycol monohexyl ether, monoethyleneglycol monohexyl ether, monoethyleneglycol monobutyl ether, and mixtures thereof.

A particularly preferred type of non-aqueous solvent are diols having from 6 to about 16 carbon atoms in their molecular structure. The diol solvents are especially preferred because, in addition to good grease cutting ability, they impart to the composition an enhanced ability to remove calcium soap soils from surfaces such as bathtub and shower stall walls. These soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Solvents such as pine oil, orange terpene, benzyl alcohol, n-hexanol, phthalic acid esters of $C_{1-4}$ alcohols, butoxy propanol, Butyl Carbitol® and 1(2-n-butoxy- 1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

Solvents with little or no cleaning action can also be used in the concentrated liquid composition. Examples of such solvents include methanol, ethanol, isopropanol, ethylene glycol, propylene glycol, and mixtures thereof.

EXAMPLES

The concentrated liquid detergent compositions of the present invention are illustrated by the following examples. All values are percents by weight. All examples represent 5× concentrates with pH's of from about 10 to about 12.

Concentrated Liquid Hard Surface Cleaners

| | Concentrated Liquid Hard Surface Cleaners | | | |
|---|---|---|---|---|
| | Example A | Example B | Example C | Example D |
| isopropanol | 19.0 | 10.00 | 30.00 | 19.0 |
| butoxypropanol | 10.0 | 5.00 | 15.00 | 10.0 |
| Dodecyl dimethyl amine oxide | — | — | — | 0.80 |
| Varion CAS | 0.80 | 0.80 | 0.80 | — |
| Sodium Alkyl Sulfate | 0.10 | — | 0.09 | 0.10 |
| Monoethanolamine | 1.25 | 1.25 | 2.50 | 1.25 |
| Sokalan CP-9 polymer | 0.18 | 0.25 | 0.20 | 0.18 |
| dye | 0.02 | 0.02 | — | 0.02 |
| perfume | — | — | 0.65 | — |
| distilled/soft water | 68.65 | 82.68 | 50.76 | 68.65 |

What is claimed:

1. Concentrated liquid detergent composition suitable for dilution with hard or de-ionized water, comprising, based on the total weight of said composition:

(a) about 1% of a maleic acid-olefin copolymer having the formula:

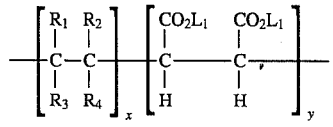

where $L_1$ is hydrogen, ammonium or an alkali metal; $R_1$, $R_2$, $R_3$ and $R_4$ are independently selected from the group consisting of hydrogen and an alkyl group containing from 1 to about 8 carbon atoms; and the monomer ratio of x to y is from about 1:5 to about 5:1;

(b) from about 0.05 to about 10% detergent surfactant, (c) from about 0.5% to about 10% beta-aminoalkanol containing from about 3 to about 6 carbon atoms and/or monethanolamine;

(d) a pH of from about 9 to about 13; and (e) less than about 60% water.

2. The composition according to claim 1 wherein the monomer ratio of x to y is from about 1.5:1 to about 1:1.5.

3. The composition according to claim 1 wherein $R_1$, $R_2$, $R_3$ and $R_4$ are independently selected from the group consisting of hydrogen and an alkyl group containing from about 1 to about 5 carbon atoms.

4. The composition according to claim 1 wherein the detergent surfactant is a hydrocarbyl amidoalkylenesulfobetaine having the formula

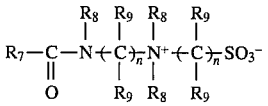

wherein each $R_7$ is an alkyl group containing from about 8 to about 20 carbon atoms; each $R_8$ is selected from the group consisting of hydrogen, alkyl groups containing from 1 to about 4 carbon atoms and substituted alkyl groups containing from 1 to about 4 carbon atoms; each $R_9$ is selected from the group consisting of hydrogen and hydroxy groups; and each n is a number from 1 to about 4 with no more than about one hydroxy group in any $C(R_9)_2$ moiety.

5. The composition according to claim 4 wherein each $R_7$ is an alkyl group containing from about 12 to about 16 carbon atoms; each $R_8$ is selected from the group consisting of methyl, ethyl, propyl, hydroxy substituted ethyl, hydroxy substituted propyl, and mixtures thereof, and each n is from about 2 to about 3.

6. The composition according to claim 1 wherein the detergent surfactant is an amine oxide.

7. The composition according to claim 6 wherein the amine oxide has the formula

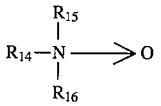

where $R_{14}$ is an alkyl group comprising from about 10 to about 28 carbon atoms, $R_{15}$ and $R_{16}$ are alkyl or hydroxyalkyl groups comprising from 1 to about 3 carbon atoms.

8. The composition according to claim 1 wherein the detergent surfactant comprises an amphocarboxylate detergent surfactant having a chain length of from 8 to 10 carbon atoms.

9. The composition according to claim 8 further comprising a hydrocarbyl amidoalkylenesulfobetaine detergent surfactant wherein the ratio of the amphocarboxylate to the hydrocarbyl-amidoalkylenesulfobetaine is from about 1:3 to about 3:1.

10. The composition according to claim 8 wherein the ratio of amphocarboxylate to hydrocarbyl-amidoalkyenesulfobetaine is from about 1:1.5 to about 1.5:1.

11. The composition according to claim 1 wherein the detergent surfactant comprises an anionic surfactant having the formula

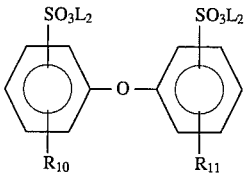

where $R_{10}$ and $R_{11}$ are alkyl groups each independently comprising from about 8 to about 16 carbon atoms, and $L_2$ is selected from the group consisting of hydrogen, sodium, ammonium, magnesium and lithium.

12. The composition according to claim 1 wherein the composition comprises between about 45% and 55% water.

13. The composition according to claim 1 further comprising from about 10% to about 30% of non-aqueous solvents having hydrogen bonding parameters of less than about 7.7.

* * * * *